United States Patent [19]

Wahlen et al.

[11] 4,051,651

[45] Oct. 4, 1977

[54] METHOD AND APPARATUS FOR WETTING THREAD IN A DOUBLE TWIST TWISTING SPINDLE

[75] Inventors: Antonius Wahlen; Klaus-Detlef Otten, both of Remscheid, Germany

[73] Assignee: Barmag Barmer Maschinenfabrik Aktiengesellschaft, Wuppertal, Germany

[21] Appl. No.: 655,282

[22] Filed: Feb. 4, 1976

[30] Foreign Application Priority Data

| | | |
|---|---|---|
| Feb. 8, 1975 | Germany | 2505376 |
| Dec. 23, 1975 | Germany | 2558474 |

[51] Int. Cl.[2] ..... D01H 13/30

[52] U.S. Cl. ..... 57/35; 57/164

[58] Field of Search ..... 57/34 R, 35, 58.49, 57/58.7, 58.83, 106, 108, 164, 7

[56] References Cited

U.S. PATENT DOCUMENTS

| | | | |
|---|---|---|---|
| 3,159,962 | 12/1964 | Franzen | 57/35 X |
| 3,295,305 | 1/1967 | Nimtz | 57/58.49 |
| 3,295,306 | 1/1967 | Rehn | 57/164 X |
| 3,429,113 | 2/1969 | Nimtz et al. | 57/35 X |
| 3,563,019 | 2/1971 | Greive et al. | 57/164 X |
| 3,638,415 | 2/1972 | Andrews | 57/164 X |
| 3,939,635 | 2/1976 | Rehn et al. | 57/35 X |

*Primary Examiner*—Donald Watkins

*Attorney, Agent, or Firm*—Keil, Thompson & Shurtleff

[57] ABSTRACT

Method and apparatus for wetting thread as it is being twisted in a double twist twisting spindle assembly, preferably by thread contact with the wettable guide or contacting surface formed by the inner wall of a balloon limiting mantle which encircles the twist spindle. The method essentially requires a liquid thread treating agent to be delivered or directed onto the thread contacting surface under regulated pressure impulses in an amount which provides a predetermined takeup of the liquid by the thread. Suitable apparatus includes dosing means wherein the pressure on the liquid can be alternately raised and lowered to create a regulated pattern of pressure impulses, for example by using a suitable impulse generator to regulate the pressure impulses. There is provided a more effective and controlled wetting of the double twisted threads.

29 Claims, 8 Drawing Figures

METHOD AND APPARATUS FOR WETTING THREAD IN A DOUBLE TWIST TWISTING SPINDLE

This invention is directed to an improvement in the wetting of a thread, yarn, tow or the like in a double twist twisting process or so-called two-for-one twisting process wherein the thread is coated or moistened with a liquid treating agent as it is withdrawn and passed through the balloon pattern of a double twist twisting spindle. Typical liquids for treating or finishing the twisted thread include well known lubricated agents such as oils, greases, waxes or the like, which may be dispersed in an aqueous medium together with other additives such as emulsifiers and antistatic agents. It is especially desirable to apply a superficial coating of a liquid lubricant under pressure and in a measured amount to a stationary balloon-limiting mantle, i.e. to its inner surface around the twist spindle, in order to prevent or substantially eliminate the formation of fiber dust caused by frictional contact of the running twisted thread against this surface.

One method of this kind for lubricating a thread and suitable apparatus which has been substantially adopted in a large industrial operation is that disclosed in U.S. Pat. No. 3,295,306. Suitable lubricating agents and the purpose for their application to the twisted thread in the baloon mantle are explained in detail in this patent, the subject matter of which is therefore incorporated herein by reference as fully as if set forth in its entirety. For the description of an especially useful wetting means in a balloon limiter, attention is also directed to U.S. application Ser. No. 551,065, filed Feb. 19, 1975, now U.S. Pat. No. 3,939,635, which is also incorporated herein by reference.

Another thread wetting method is disclosed in the earlier U.S. Pat. No. 3,159,962 for treatment of the thread in the twisting spindle with steam or another fluid or liquid treating medium introduced by means of a nozzle into a confined space within the thread storage disc coaxially arranged at the bottom end of the spindle, the thread passing freely through the treating medium in this confined space. In this method, the thread is subjected to a liquid or vaporous spray only for a very brief period of time as it passes the nozzle head or outlet. Most of the vapor or liquid is wasted in this vapor or liquid feed device such that the fluid consumption is very high and uneconomical. Moreover, the excess liquid or vapor as a condensate has a very disadvantageous effect as it accumulates on the twist spindle, i.e. in the storage disc and along its exit openings. Finally, although there is a continuous feed of vapor or liquid onto the thread as it passes through the storage disc, it is not possible to provide a uniform wetting of the thread over its running length.

In all such double twist twisting processes and apparatus, it has now become apparent that the liquid takeup or absorption by the thread or yarn ought to be carefully regulated in a predetermined manner to provide a uniformly wetted or moistened thread for use in various types of textile or thread processing operations which follow the twisting process. This careful application of a liquid treating agent is essential for a number of reasons as explained more fully hereinafter.

The liquid takeup or absorption by the thread can be expressed by the equation:

$$A = \frac{\text{wt. of liquid treating agent}}{\text{wt. of the thread}} \cdot 100\ (\%)$$

For the determination of this takeup or absorption value A, one can first calculate the weight of the dry thread or yarn over a specific length, e.g. 100 meters, in accordance with its titer or yarn size, and a wetted thread of this same length can then be weighed. The percentage absorption or takeup as a surface coating on the twisted thread is then calculated from these two weights as the value "A" in the above equation.

It is a primary object of the present invention to provide a method and apparatus for wetting a thread in the double twist twisting process whereby the liquid takeup of the thread may be controlled with a high degree of accuracy and in a predetermined manner, thereby providing a substantial improvement over earlier methods and apparatus. Other objects and advantages of the invention will become more apparent from the following detailed disclosure.

In accordance with the invention, it has now been found that the wetting of the thread with a liquid treating agent, especially a lubricant, can be carried out in an advantageous manner during the double twist twisting of the thread as it is drawn from a delivery bobbin, passed through a hollow twist spindle and then directed outwardly into a balloom pattern, by the steps which include conducting the thread in contact with a wettable surface during the twisting operation and supplying the liquid treating agent in a discontinuous stream for application by means of regulated pressure impulses to the wettable surface in a measured amount providing a predetermined liquid takeup by the thread. The liquid is preferably applied as a jet or spray onto the wettable surface contacted by the thread, or the liquid may also be passed or conducted under controlled pulsations directly through openings or pores in the wettable surface. It is particularly useful to use the balloon limiting guide surface, i.e. the inner wall surface of the balloon mantle, as the wettable surface for contact with the thread as it passes through its rotating balloon pattern.

The thread wetting or moistening method of the invention can be readily adapted to existing double twist twisting apparatus which generally includes a hollow twist spindle for at least one thread delivery bobbin and a thread contacting surface arranged in the path of the thread being drawn from the bobbin, passed through the hollow spindle and then directed outwardly into a rotating balloon pattern around the spindle and bobbin assembly. The improvement in combination with this apparatus for applying a liquid according to the invention comprises dosing means to direct the liquid under repeated pressure impulses onto the thread contacting surface, and liquid feed control means including an impulse generator operatively connected to the dosing means to regulate the pressure impulses in accordance with a predetermined program.

The impulse generator can be provided with adjustable control means to vary both the frequency and the duration of each pressure impulse. An especially simple control is achieved when only the frequency of the pressure impulses is varied, i.e. at constant pressure and constant impulse duration.

It is also advantageous to provide a single impulse generator as well as a single liquid supply means arranged centrally of a plurality of double twist twisting spindles in a twisting machine. Also, in order to prevent the flooding or fouling of the thread contact surface of a specific twist spindle assembly in this central arrangement of the impulse generator and supply means, it is advantageous to provide automatic switch-off means to disconnect or turn off the dosing means at each twisting position, for example by means of a thread monitor actuated by breakage of the thread or its removal when the delivery bobbin runs out of thread. The switch-off means can also be provided by a sensing element actuated by the thread diameter of a winding spool which collects the thread from each twisting position.

These and other preferred embodiments and advantageous variations or combinations in the apparatus of the invention together with the improved method of wetting the thread during the double twist twisting process are explained in detail in conjunction with the accompanying drawings in which.

Figure 1:
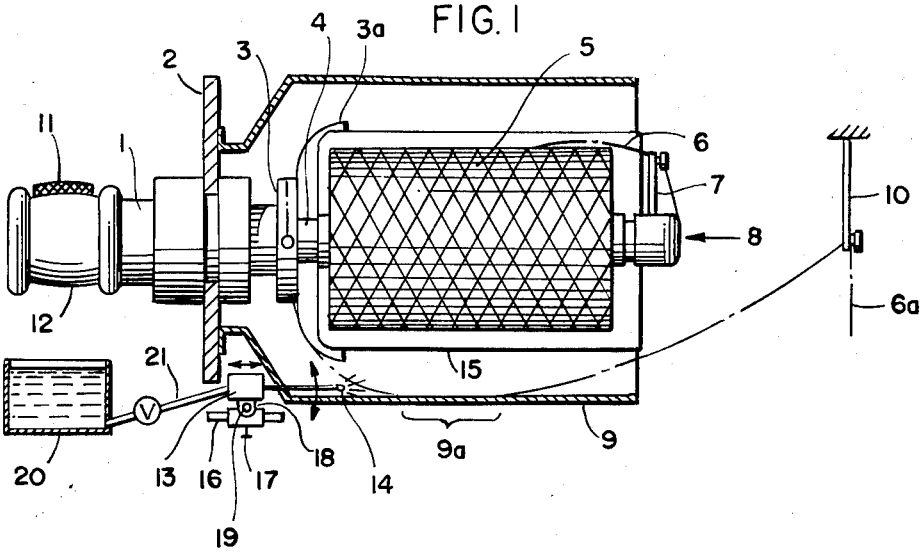
FIG. 1 is a partly schematic side view of a double twist twisting spindle with a spray or jet dosing device for applying the liquid onto the balloon limiting mantle.
Figure 3:
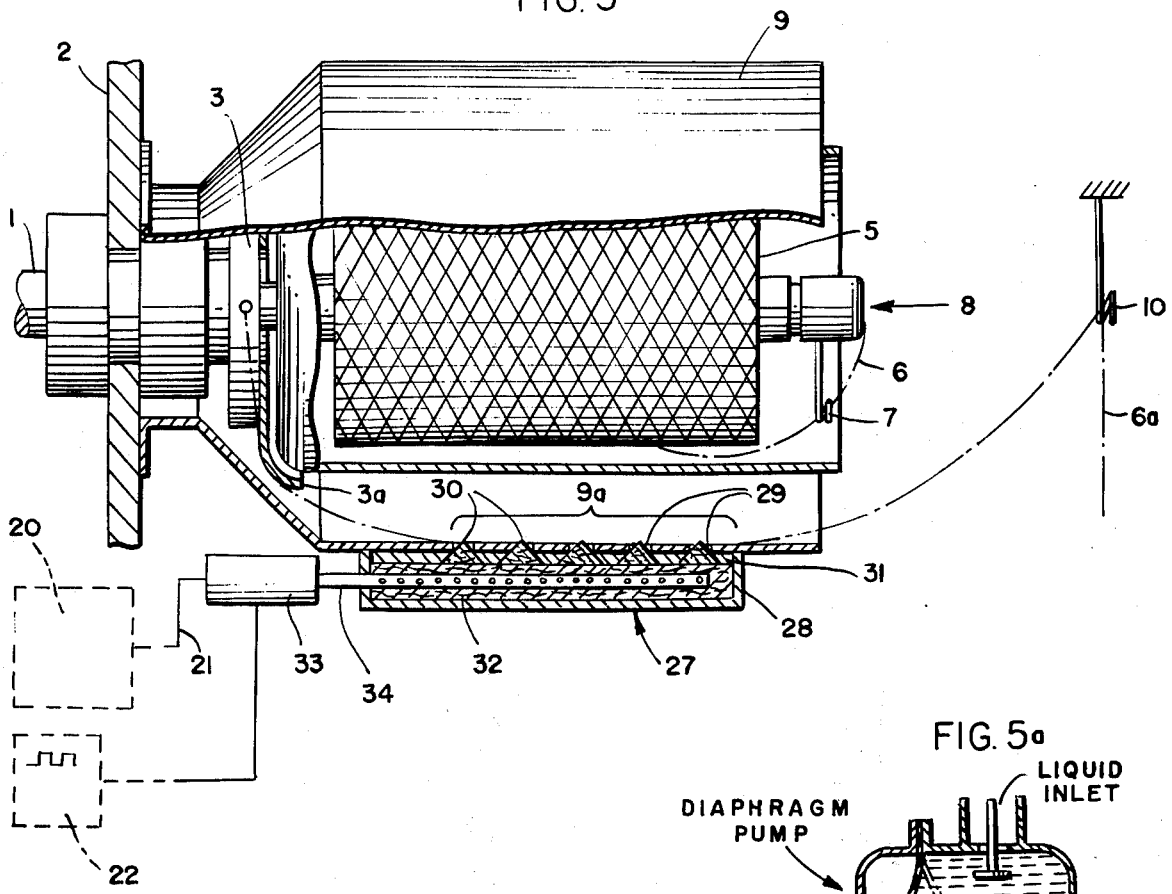
Figure 5A:
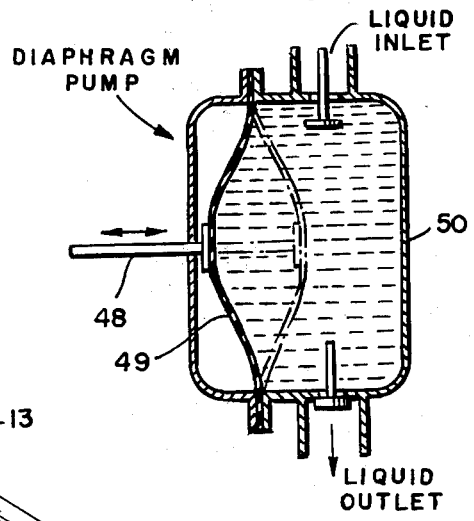
Figure 4:
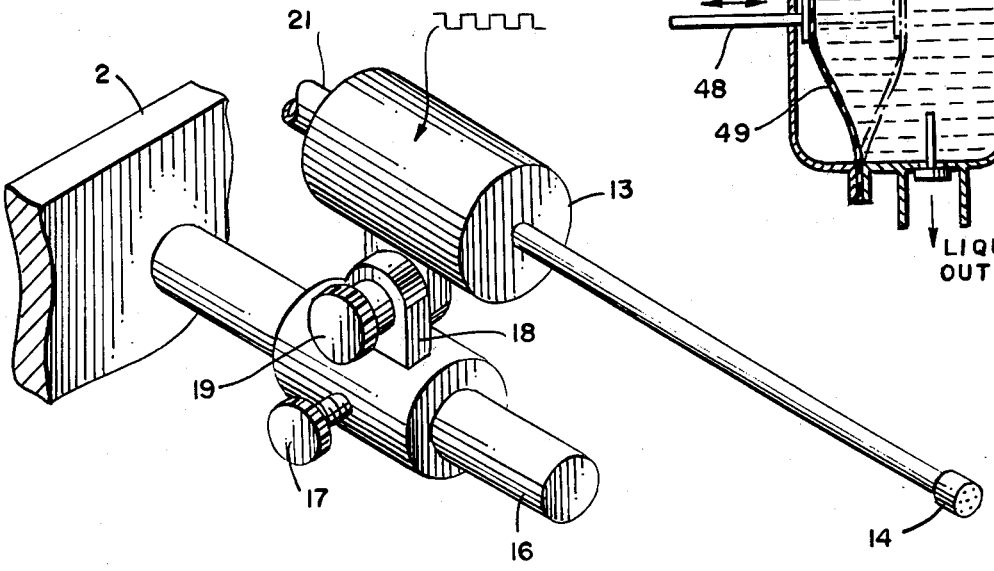
Figure 5:
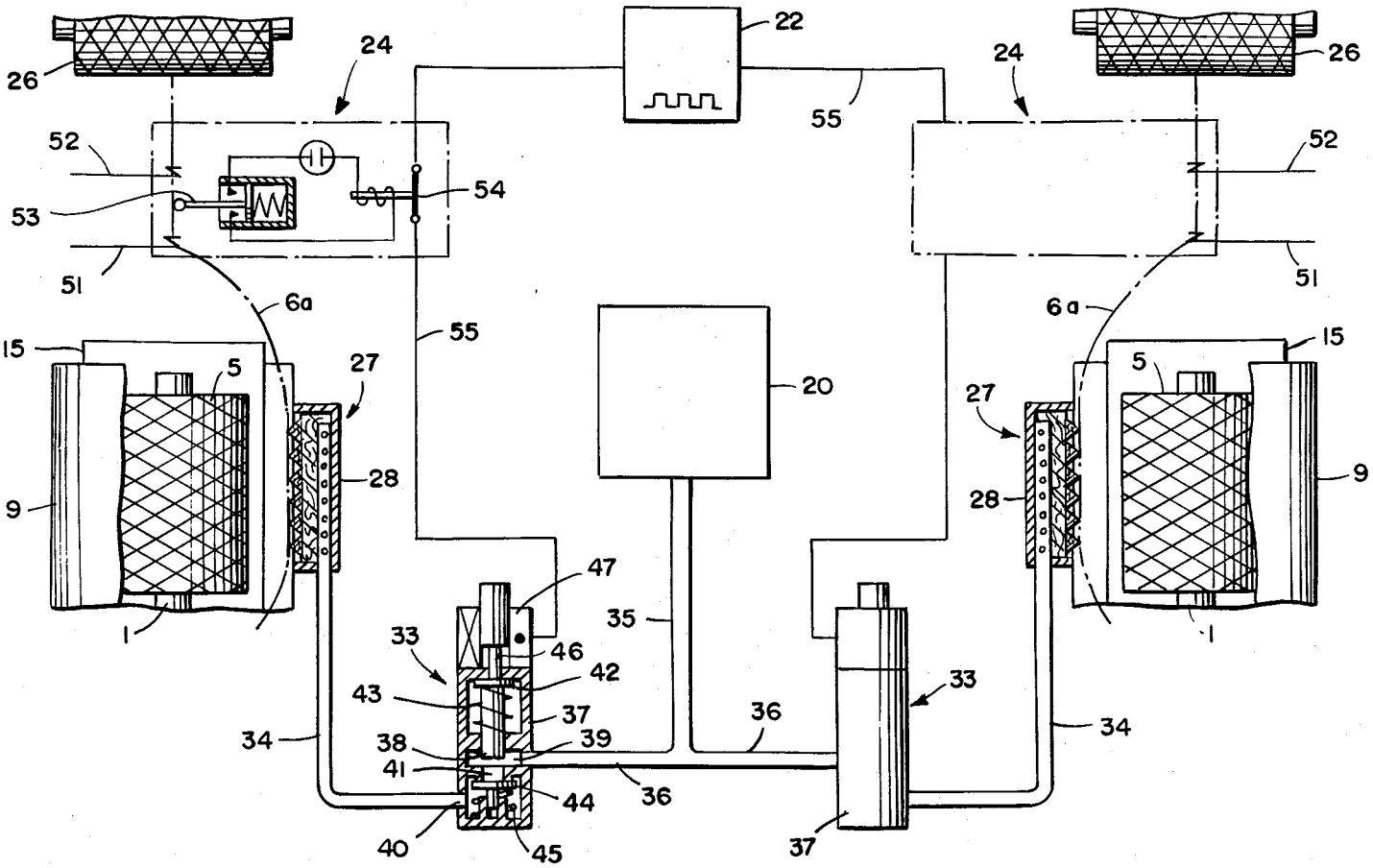
Figure 7:
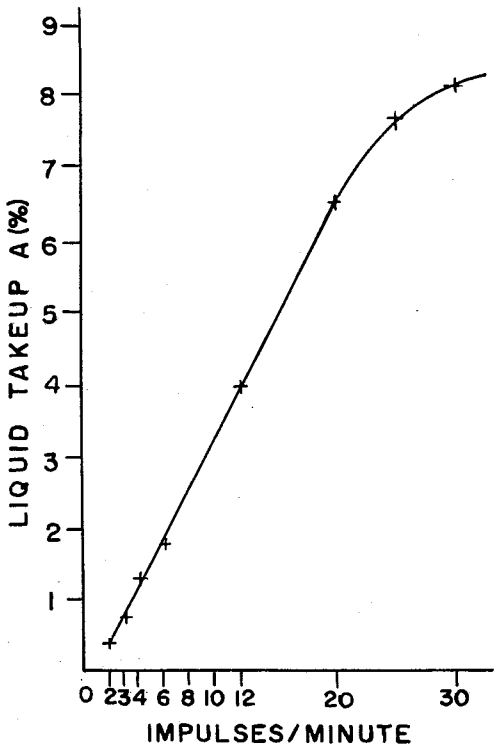
Figure 6:
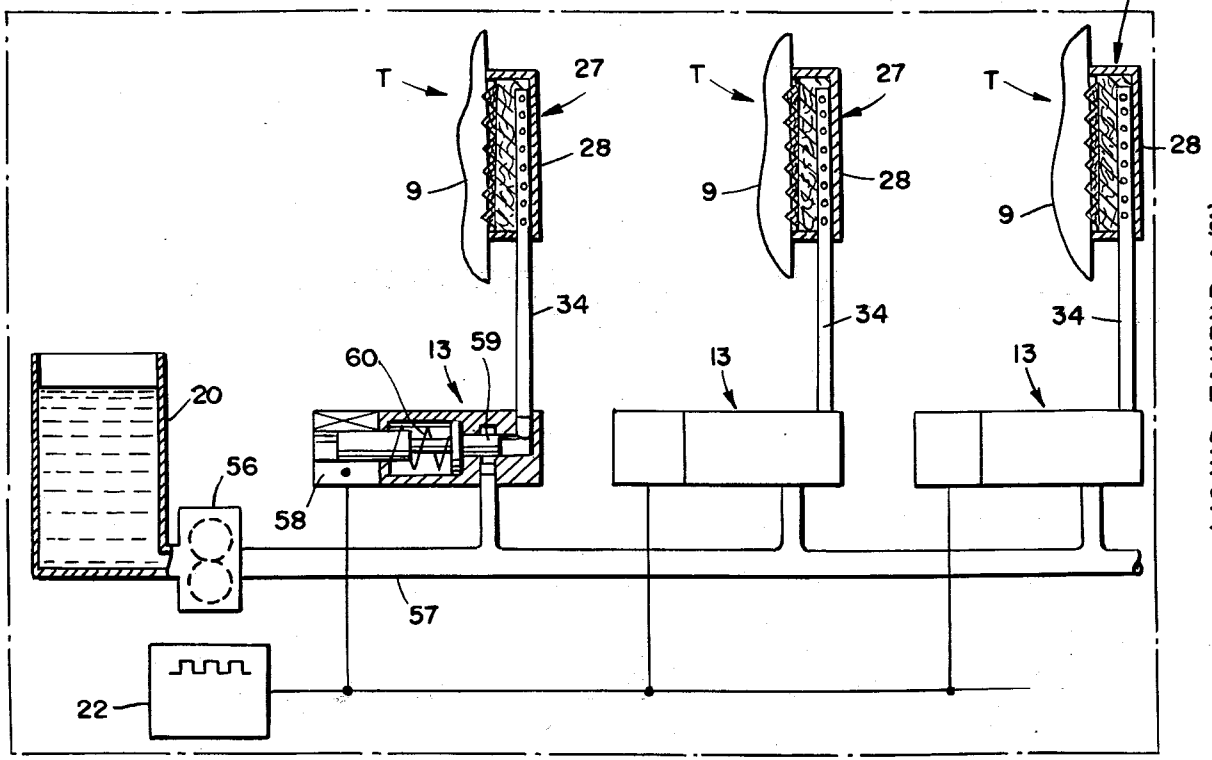

FIG. 3 is a partly schematic side view of a double twist twisting spindle in which the balloon limiting mantle is supplied with a pulsating flow of liquid from a pressure chamber as a dosing means mounted on the outside of the mantle with openings or passages through the mantle wall and porous inserts for the controlled flow and application of the liquid to the inner thread contacting wall of the mantle;

FIG. 4 is a partial perspective view of a dosing means using a spray or jet nozzle as in FIG. 1;

FIG. 5 is a schematic illustration of another combination adopting a piston pump as feed and dosing means in a double twist twisting spindle assembly corresponding to FIG. 3 and detailing the use of a thread monitor;

FIG. 5*a* is a partly schematic view taken on a longitudinal section of a suitable diaphragm pump as the feed and dosing means according to the invention;

FIG. 6 is a schematic illustration of yet another combination of feed and dosing means in a double twist twisting apparatus according to FIG. 3; and FIG. 7 is a graphical illustration of one example of the variation in liquid takeup by the twisted thread with respect to changes in the number of pressure impulses per unit time at constant pressure and constant volume of liquid feed per impulse.

Those parts or elements which remain substantially the same in the various illustrated embodiments have been designated by the same reference numeral.

Figure 2:
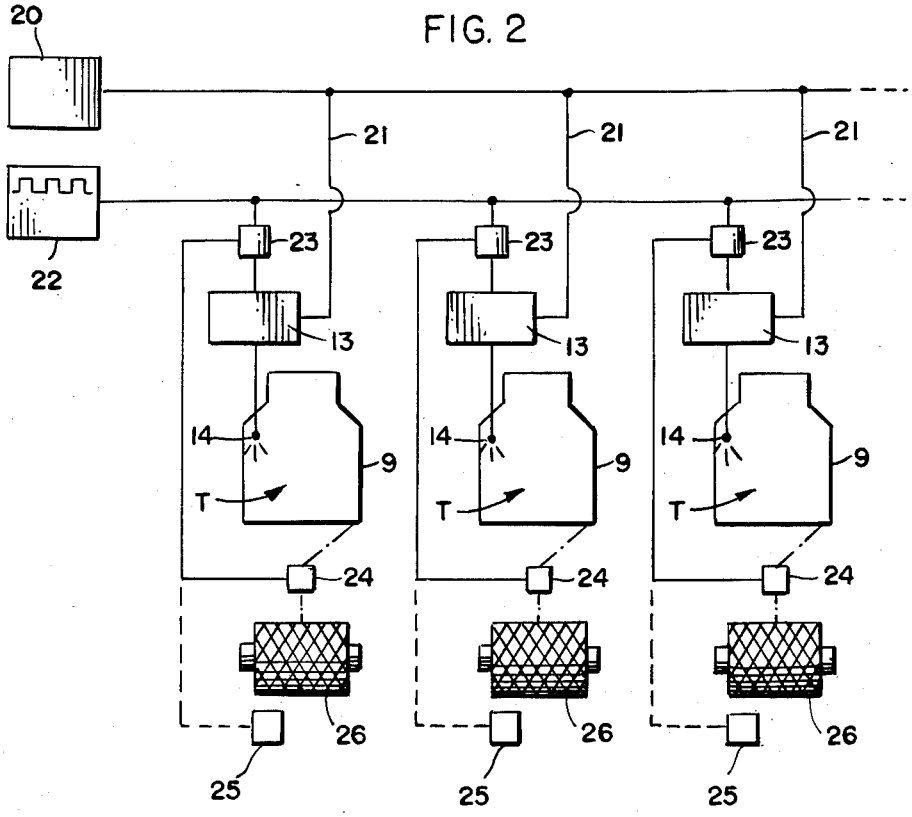
FIG. 2 is a further schematic illustration of several spindles of a double twist twisting machine using a centrally located or common supply vessel for the liquid treating agent as well as a central impulse generator to provide a regulated supply of liquid to the individual feed lines and dosing means for each twist spindle.

In the drawings, the double twist twisting apparatus or so-called two-for-one twister generally requires the use of a twist spindle 1 which is rotatably mounted in the machine frame 2 either in the horizontal position as shown in FIGS. 1 and 3 or also quite commonly in the vertical position as shown or indicated in FIGS. 2, 5 and 6. The twist spindle assembly has a conventional thread storage disc 3 fastened to the spindle 1 at one end of a bobbin holder 4 which carries the feed bobbin 5 in a freely rocking or rotatable position. The thread 6 initially wound on the full feed bobbin 5 is drawn off overhead at the outer or projecting end of the bobbin 5 and through the eyelet of the revolving drag flyer or trailer 7 mounted for rotation around the hollow bore 8 of the twist spindle where the thread 6 is then drawn back through the twist assembly. The thread emerges again from the hollow bore 8 of the twist spindle onto the thread storage disc 3 and passes outwardly to form the usual rotating balloon pattern limited by the cylindrical mantle 9. The twisted thread 6*a* is then drawn off through the stationary guide element 10. The thread balloon as illustrated in FIG. 1 contacts the inner surface of the mantle 9 on a cylindrical wall area or circumferential contact surface having the axial extension 9*a* where the balloon is slightly flattened over a certain length of the running twisted thread 6*a* as it leaves the twist assembly.

The twist spindle 1 is rapidly turned as indicated in FIG. 1 by the drive belt 11 in a frictional engagement with the whorl or driven collar 12 arranged at the inner end of the spindle. The storage disc 3 with its attached runoff or twist guide 3*a* is also turned along with the driven spindle to assist in directing the thread into its rotating balloon pattern.

The balloon limiter 9 has a cylindrical cross-section concentric to the delivery bobbin 5 and mounted at its inner end to the frame 2. A combined feed and dosing means 13 has a projecting spray nozzle 14 which extends into the interior of the balloon limiter 9 so that the liquid spray from the nozzle can be directed onto the thread contacting surface 9*a*, preferably at a point just outside the balloon and just within the inner wall of the balloon and just within the inner wall of the balloon limiter 9. The cylindrical protective pot or can 15 is placed around the delivery bobbin 5 within the balloon.

As shown in greater detail in FIG. 4, this dosing means 13 with nozzle 14 is axially shiftable on the guide rail or rod 16 which is fastened to the frame 2, and the axial position is fixed by means of the fastening screw 17. The nozzle 14 may also be tilted or pivoted by a suitable mounting bracket 18 and fixed at the pivot point 19 by another suitable screw means.

The dosing means 13 and projecting nozzle 14 may also be arranged at the other outboard or open end of the balloon limiter 9. A mist or spray of the liquid is preferably directed for periodic or intermittent deposit onto the thread contacting surface 9*a* under a pulsating feed which provides a measured amount of liquid with each pressure impulse. One should avoid an excess coating of the inner wall of the balloon limiting mantle or the protective pot around the delivery bobbin. Relatively small amounts of the liquid serve to uniformly coat the thread contacting wall surface and provide a uniform coating or impregnation of the twisted thread in this spray nozzle embodiment. Also, it is not necessary to provide openings or perforations in the wall of the balloon limiter along the thread contacting surface thereof, this surface remaining smooth and free of imperfections or variations in its circular cross-section so that inadvertent damage to fine denier threads can be completely avoided.

Where the balloon limiter is mounted vertically with its outboard end directed downwardly as in FIG. 2, the spray from nozzle 14 can be in the form of relatively large droplets deposited carefully onto the inner wall only of the balloon limiting mantle, thereby ensuring a carefully measured pulsating flow of liquid onto the thread contacting surface without spreading or fouling other parts of the apparatus.

The source or main supply of the treating liquid can be held in the liquid tank or container 20 and connected with the dosing means 13 over a suitable feed line 21 with the liquid supplied under the pressure of the liquid in container 20 to the dosing means 13 equipped to impart the pressure impulses or else by means of separate pumping and impulse generator means. Thus, it is suitable to provide exactly measured liquid amounts dosed through the nozzle 14 at regulated time intervals for discontinuous application onto the circumferential contact surface 9*a*. In either the horizontal or vertical arrangement of the twist spindle, the liquid is preferably ejected from the nozzle 14 with a flow velocity and direction sufficient to achieve a predetermined width of spray for deposit on the inner wall surface of the mantle 9. When arranging the twist spindle assembly in an inclined position with the outboard end directed downwardly, the liquid can be issued from the nozzle 14 under only a slight pressure and with very slow stream velocity in the form of individual drops or an interrupted jet, depending upon gravity flow down the inner wall surface of the mangle 9 and the balloon action of the thread to uniformly coat both the wall surface and the thread. Only a single feed and dosing means is required around the circumference of the balloon limiter in this embodiment, i.e. using a single nozzle feed 14, although it will be apparent that two or more nozzles may be distributed around this circumference on a single feed line.

The drop point or points of spray application of the liquid preferably lie closer to the storage disc 3 of the twist spindle than to the thread guide or trailer 10 because the thread travels toward this guide 10 and carries the liquid in this same direction. The guide 10 may advantageously form part of a thread monitor device as illustrated for example in U.S. Pat. No. 3,701,247, incorporated herein by reference. For purposes of the present invention, such as thread monitor can be used to disconnect or switch-off the liquid dosing means as explained more fully below.

The rotating balloon distributes the liquid treatment agent such as a lubricant or the like over the circumferential contact surface of the balloon limiter 9 so as to improve the frictional properties of this surface. At the same time, the outer surface of the thread is also uniformly coated during such contact with the balloon limiter. When treating staple fiber yarns or threads in this double twist twister, the radially projecting fiber ends are thus laid over axially and smoothed into the outer thread surface. Moreover, broken fiber ends are greatly reduced or even eliminated by such a lubricating operation. While such treatment of the thread with a lubricating liquid is the most common treatment of the thread in this process, it will be understood that other liquid finishing agents may also be used.

The dosing means in each instance must provide not only a regulated feed with a substantially discontinuous or interrupted flow of liquid but also a controlled series of pulsations or pressure impulses imparted to this feed. Such pressure impulses can be achieved by simply opening and closing a valve V in the feed line 16 from a pressurized source of liquid supply 20 as indicated by FIG. 1 or by means of suitable pump and valve combinations as indicated by the piston type pumps of FIGS. 5 and 5*a*.

The operation of such valves or pump/valve combinations as the dosing means should be regulated by an impulse generator 22 so that the amount of liquid introduced is just sufficient to wet the contact surface of the balloon limiter as well as coating or impregnating the thread in the desired manner. This general operation is illustrated schematically in FIG. 2 for a plurality of individual twist spindles in a double twist twisting machine.

The individual twist spindle assemblies T are indicated by their outline in FIG. 2, including the balloon mantle 9. The liquid supply container 20 is located centrally of the entire machine and feeds liquid over the individual feed lines 21 to each dosing means 13 and nozzle 14 arranged as shown in FIGS. 1 and 4 at each twisting position in the machine. The individual dosing means 13 are controlled by a central or common impulse generator 22 operatively connected in the manner shown. The impulse being generated in terms of the liquid feed is preferably the illustrated square-wave pulsation as achieved by a suitable electrical control circuit, although it is also feasible to provide other conventional control means including hydraulic or pneumatic systems operating on the same principle.

For example, the dosing means 13 may include a valve which is opened and closed at preset intervals and for preset periods of time by the impulse generator 22 which initiates a pulse train, signal or similar control impulse to the dosing means. The terms "pulse" and "pulse initiator" are more commonly used with reference to electrical or electronic control signals but the terms "impulse" and "impulse generator" have been employed herein to include electrical, hydraulic and pneumatic control signals.

Each twist position in the machine illustrated in FIG. 2 also has an automatic shut-off switch 23 to stop the flow of liquid feed, this switch 23 being actuated by the thread monitor 24 which operates the switch in response to a thread breakage and/or by the sensing element 25 which also operates the switch as soon as the winding 26 is completed or at any predetermined diameter of this winding 26. These automatic switch arrangements are well-known in this art so that any suitable thread monitor or sensing element can be used, e.g. of the type disclosed in U.S. Pat. No. 3,701,247. By immediately switching off the flow of liquid to a twist position where a thread is broken or where the twist operation is completed, the deposition of excess and unwanted amounts of liquid onto the balloon limiter is avoided and there is no danger of soiling or fouling the twist machine.

For purposes of the present invention, one may employ any liquid treating or finishing agent which improves the double twist twisting process, e.g. to decrease friction of the thread on the contact surface of the balloon limiter or other machine parts, or which provides desirable properties or finishing effects in the twisted yarn for subsequent textile operations.

The double twist twisting spindle shown in FIG. 3 is essentially identical with that of FIG. 1 except that only a lower portion of the balloon mantle has been cut away to illustrate a different feed and dosing means for the liquid treating agent. In this instance the pulsating feed of liquid onto the thread contact surface 19 is accomplished by means of a pressure chamber 27 formed by a holder 28 fastened onto the outer wall of the balloon limiting mantle 9 so as to enclose a liquid chamber or casing in direct liquid communication with the inner thread contacting wall surface 9*a* by means of a plurality of slots or openings 29 which may also extend slightly in the circumferential direction, e.g. for about 10 mm. in a typical installation. Wedge shaped felt elements or similar fibrous elements are positioned in the openings 29 as very porous and absorbent inserts. These inserts 30 preferably fill up the openings 29 and even project at their upper apex or edge for a short distance, e.g. about 1 mm., into the circular interior of the balloon limiter 9 so as to come into direct contact with the thread as it passes over the area 9*a*. The chamber or casing 28 is closed on all sides to provide a pressure tight enclosure for the liquid while preferably being filled with absorbent felt or other fibrous materials 31 and 32 which assist in holding the wedge shaped inserts 30 in place while also transmitting liquid thereto. This general construction of a pressure chamber containing at least one insert of an absorbent material impregnated and fully immersed in the treatment liquid has been described in detail in the above-noted U.S. application Ser. No. 551,065 but with different means of feeding or dosing the pressure chamber or casing containing the absorbent material.

In the present invention, the wetting or liquid applying felt inserts 30 and the fillers 31 and 32 are supplied with liquid under pressure impulses by the feed or dosing means 33 through the feed pipe 34 which is perforated as it extends within the chamber 28 for uniform distribution of the liquid. It is desirable in this case to place the liquid under substantial pressure in pulses or preferably repeated feed pulses by means of the dosing device 33. As further shown in FIG. 5, each of several twist spindle units in a double twist twisting machine is equipped with its own dosing device 33 which is connected to a common supply tank 20 and also a common impulse generator 22.

The dosing devices 13 or 33 as provided in the apparatus of the invention can be constructed in a number of different ways with either a valve means alone or with combined valve and piston means as schematically illustrated by way of example in each of FIGS. 5, 5*a* and 6.

Referring first to FIG. 5, the supply tank 20 can be arranged centrally or at one end of the twisting machine and the liquid conducted through the central feed conduit to the branched feed lines 36 to the combined feed and dosing device 33 arranged at each twist position. One of these devices is shown schematically as a piston pump in FIG. 5, viewed as a longitudinal section along the axis of the cylinder or piston housing 37. This piston pump has a piston 38 which can move easily back and forth in the bore of the cylinder 37 between and inlet 39 and outlet 40 of the bore segment 41 located so as to be closed off from the inlet 39 during the downward stroke of the piston 38. The collar or stop means 42 limits the upward axial movement of the piston 38 with the spring 43 resiliently pressing the piston up to its stopped position. The bottom end of the bore 41 is closed by the plate check valve 44 which is pressed onto the valve seat by the spring member 45. The piston 38 is moved downwardly against the spring 43 by the magnetically operated push or drive rod when the magnet 47 is energized by means of the common impulse generator or pulse initiator 22 in accordance with a predetermined, adjustable frequency. With the activation of the magnet 47, the bottom end of the piston 38 plunges into the bore segment 41, simultaneously closing off the bore inlet 39 and providing a feed pressure sufficient to open the check valve 44 against spring 45. This feed pressure is then transmitted by the liquid through the perforated feed pipe 34 into the pressure chamber 27. Under this transmitted pressure, the liquid is forced through the felt inserts 30 in a positive pulsating flow into the interior of the balloon limiter 9 as shown in greater detail in FIG. 3.

A combination feed and dosing device such as the piston pump 33 of FIG. 5 has the capability of supplying the smallest feed amounts at high pressures up to about 10 bars with exact dosing frequencies. The amounts of the liquid being applied to the inner surface of the balloon limiter can be controlled with this device solely by changing the frequency of the magnetically actuated piston. This relatively simple control of the feed of the liquid represents a special advantage for this embodiment.

By means of preliminary calibrating tests, one can establish the exact relationship between the frequency of the pressure impulses and the liquid takeup by the thread when using a piston pump or any other suitable dosing means operating under a specific frequency of pressure impulses while the applied pressure and feed volume per impulse remain constant.

Another suitable piston pump is illustrated schematically in FIG. 5*a* in the form of a typical diaphragm pump in which the piston 48 moves the diaphragm 49 back and forth to alternately open and close the upper inlet check valve and lower outlet check valve, respectively. Thus, when the volume in the cylinder or vessel 50 is increased by moving the piston 48 and flexible diaphragm 49 outwardly, the upper valve opens while the lower valve closes. Then, as the piston is moved inwardly to the opposite position of the diaphragm (phantom lines), a high pressure is exerted on the liquid, closing the upper valve while opening the lower valve and transmitting the pressure through the exit line. This diaphragm pump is otherwise used in the same manner as the piston pump shown in FIG. 5 and is capable of being operated at relatively high frequencies.

In FIG. 5, there is further illustrated a suitable automatic switch-off mechanism 24 actuated by breakage or removal of the thread 6*a* through the two upper thread guides 51 and 52. Once the thread is absent between these guides, the spring actuated thread monitor or sensor 53 moves outwardly to close a circuit which in turn disconnects the switch 54 from the transmitting line 55 running from the impulse generator or pulse initiator 22 to the magnetically operated piston pump 33. The switch-off means 24 can also function by operating a blocking circuit to prevent the impulses or pulse train from reaching the piston pump 33, for example in hydraulic or pneumatic systems as well as the illustrated electrical system of transmitting impulses. These and similar variations can be readily adopted from available switch-off or stopping means commonly used in this art.

Another useful combination is shown in FIG. 6 with a central supply tank 20 providing liquid to a series of twist positions T, again providing a central impulse generator 22 to regulate the feed of liquid to each individual dosing means. This embodiment differs from the piston pump feed of FIGS. 5 and 5*a* by reason of the fact that a central or common gear wheel or metering pump 56 is provided at the outlet of the tank 20 as a separate feed means to provide the liquid to the main distributor line 57 under a constant pressure. This constant pressure is then transmitted by the branch feeder lines 58 through the dosing means 13 in its open position to the pressure chamber 27 enclosed by the casing 27, with an individual dosing and porous wetting means being provided at each twist position T. Only a small portion of the balloon limiter 9 is shown here for each twist spindle which is otherwise identical to the preceding embodiments.

The dosing devices 13 in FIG. 6 is magnetically operated valves which are opened by the impulse generator 22 energizing the magnet 58 to withdraw the piston 59 against the inward pressure of the spring 60, thereby permitting the constant pressure to send a pulsating charge of liquid through the open valve into feed pipe 34. The valve closes again in the second half of the impulse cycle as the magnet is deenergized by the impulse generator and the spring returns the valve piston to its original position. The pressure impulses to the chamber 27 are thus regulated by the simple opening and closing of the valve dosing means 13 under a constant feed pressure of the supplied liquid. In this case, the liquid takeup by the thread is dependent upon feed pressure developed by the rotational speed of the gear pump 56 as well as the frequency and duration of the impulses imparted by the impulse generator 22. Because of the greater number of parameters which must be exactly controlled in this valve dosing means, i.e. the pressure, the impulse frequency and the impulse duration, operation is much less certain and less advantageous than the piston pump embodiments of FIGS. 5 and 5*a*. However, when combined with a spray or jet nozzle or where other wetting means can be used under relatively lower pressures, the valve dosing means of FIG. 6 can be adopted to provide the desired discontinuous supply stream of the treating liquid for direct wetting of the thread contacting surface or surfaces in the balloon timer.

In all of the disclosed embodiments according to the present invention, there is a point in the feed or supply of the treatment liquid where the flow stream is interrupted or briefly discontinued to create the desired pressure impulse. When using a spray or jet nozzle for application of the liquid to the thread contacting surface, the resulting application also tends to be substantially discontinuous, especially at large pressure variations. However, when using the pressure chamber with its porous or highly absorptive fibrous inserts and/or packing, the flow of liquid at the point of application along the inner wall of the balloon limiter is relatively continuous, partly due to the wicking action of the absorptive fibrous material. Accordingly, the present invention offers both continuous and discontinuous wetting of the thread contact surface under regulated pressure impulses which are preferably developed under conditions of discontinuous supply. Some minor leakage in the supply valves or pistons pumps can be tolerated in this substantially discontinuous dosing or supply to the point of liquid application.

The following example will further illustrate the preferred embodiment according to FIG. 5, i.e by using a piston pump as the essential dosing means with a variable impulse frequency. One effective dosing device of this kind has been operated with a feed or delivery volume of 0.01 $cm^3$/stroke and a stroke frequency or impulse frequency ranging between 1 and 30 impulses per minute. When installed on an existing double twist twisting machine, it was possible to determine a very precise relationship between the impulse frequency and the liquid takeup by the thread as shown in FIG. 7 of the drawings. The thread used in this test was a polyester (polyethylene terephthalate) thread composed of staple fibers and having a metric yarn number or size (Nm) of 40/2. The twist spindle was operated at a constant speed of 10,000 r.p.m. to provide a twist of 605 twists/meter while supplying a conventional textile finishing oil as a lubricant. In FIG. 7, the number of strokes or impulses per minute are plotted on the abscissa while the ordinate is used to plot the liquid takeup "A" as defined by the equation given above.

It will be noted that the liquid takeup by the thread is almost a straight line function of the impulse frequency up to about 22 impulses per minute before the plotted line begins to curve and flatten out. Thus, relatively large amounts of liquid up to about 7% by weight with reference to the thread can be preset with a high degree of accuracy simply by adjusting the impulse frequency. It is also important that such results are achieved without any waste of liquid during the twisting operation or when the thread is absent.

The method of the invention offers a number of advantages, especially due to the fact that the liquid is supplied under the action of the pressure impulses so as to create relatively large variations in pressure or definite pulsations at the point of application onto the thread contacting surface. Such pulsations prevent stoppages in the feed lines and especially in the means for application of the liquid to the thread contacting surface whether such apllicating or wetting means is in the form of porous wall surfaces, felts, fibrous webs, sponges or other similar porous and absorptive materials.

In prior apparatus and methods, it has been extremely difficult to provide a small but definite stream of liquid exactly corresponding to the desired takeup by the thread, especially for the now apparent reason that interfacial film adhesion occurs in liquid streams flowing too slowly through the dosing and wetting apparatus. One cannot control the rate of liquid flow and the rate of feed application remains inexact and incapable of being preset for a particular thread or yarn. On the other hand, if the liquid feed is placed under a high pressure sufficient to cause an even and continuous flow of the liquid in the wetting means, then the amounts of liquid are too great so that excess liquid accumulates without being taken up by the thread. This excess liquid is most troublesome because it is dispersed in a manner which can cause a fouling or undesirable wetting or lubrication of other parts of the twist spindle.

By comparison, the method of the present invention permits an exact dosage or application of liquid to take place without stoppages or indefinite rates of feed on the one hand and also without creating an overflow of excess liquid on the other hand. By relying on pressure impulses and creating a definite pulsating flow at the point of application to the wettable thread contacting surface, the amount of applied liquid and its rate of application can be controlled in the present invention within comparatively wide limits and by means of several different parameters, e.g. the height of the pressure impulse, the amount of liquid delivered per impulse and the number of impulses per unit time. Especially good results are achieved when using only a variation in the impulse frequency to control the liquid application.

In the method and apparatus of the invention, the liquid treating or finishing agent is always spread very uniformly over the inner circumferential thread contacting surface of the balloon limiter, and because of the carefully measured and dosed amounts of this liquid as it is introduced through nozzle means or porous wetting means, the takeup by the thread is also very uniform during the entire twisting operation. When using a liquid lubricant, it is not only uniformly applied over the length of thread but it also effectively prevents the projection of fiber ends which through friction and overheating would otherwise break off during contact with the balloon mantle so as to cause excessive formation of a fiber dust.

In addition to the fact that the present invention offers a much more easily controlled wetting or lubrication of a thread in the known double twist twisting process, it is especially important to note that the new method and apparatus offer a wide range of utility due to an excellent adaptability to all variations which one must deal with for the purpose of providing different textile threads and finished products. The use of either a nozzle means or a porous or absorptive wetting surface, especially within the balloon limiter, permits a precise point of application of the liquid for any size or type of twist spindle assembly and practically all operating parameters such as spindle speed, yarn size and amount of twist, balloon pattern, or the like. Moreover, the exact amount of liquid can be supplied under optimum wetting conditions regardless of the linear speed of the thread, its absorptivity or its strength. Once the operating conditions of the twist spindles are established and the pulsating flow of liquid is determined for a particular thread or yarn, very few if any further adjustments are needed over long periods of operation. All of these factors result in an especially efficient and economical double twist twisting method and its application to already existing apparatus requiring only a few additional modifications in accordance with the invention.

The invention is hereby claimed as follows:

1. In the double twist twisting of a thread drawn from a delivery bobbin, passed through a hollow twist spindle and then directed outwardly into a balloon pattern, the improved method for wetting said thread with a liquid as a treating agent which comprises:

conducting the thread in contact with a balloon limiting guide surface as a wettable surface from which the liquid is applied to the thread being conducted in said balloon pattern; and supplying said liquid in a discontinuous jet or spray under regulated pressure impulses for application onto the wettable balloon limiting guide surface contacted by the thread and in a measured amount providing a predetermined liquid takeup by the thread.

2. The method as claimed in claim 1 wherein the frequency of the pressure impulses of the supplied liquid for said discontinuous jet or spray is regulated while maintaining a constant liquid pressure, a constant duration of each impulse and a constant amount of supplied liquid per impulse.

3. In the double twist twisting of a thread drawn from a delivery bobbin, passed through a hollow twist spindle and then directed outwardly into a balloon pattern, the improved method for wetting said thread with a liquid as a treating agent which comprises:

conducting the thread in contact with a wettable surface during said double twist twisting;

passing said liquid through openings in said wettable surface while supplying the liquid to said openings in a discontinuous stream under regulated pressure impulses for application onto the wettable surface contacted by the thread and in a measured amount providing a predetermined liquid takeup by the thread.

4. The method as claimed in claim 3 wherein the frequency of the pressure impulses of the supplied liquid for said discontinuous stream is regulated while maintaining a constant liquid pressure, a constant duration of each impulse and a constant amount of supplied liquid per impulse.

5. The method as claimed in claim 3 wherein said wettable surface is a balloon limiting guide surface from which the liquid is applied to the thread being conducted in said balloon pattern.

6. In a double twist twisting apparatus having a hollow twist spindle for at least one thread delivery bobbin and also having a balloon limiting mantle with a thread contacting surface encircling the twist spindle to limit the outward balloon path of thread which is drawn from the bobbin, passed through the hollow spindle and then directed outwardly into a rotating balloon pattern, the improved means for applying a liquid as a thread wetting agent onto said thread contacting surface which comprises:

dosing means including a nozzle positioned within said balloon limiting mantle to direct said liquid as a jet or spray under repeated pressure impulses onto said thread contacting surface; and liquid feed control means including an impulse generator operatively connected with said dosing means to regulate said pressure impulses.

7. Apparatus as claimed in claim 6 wherein said impulse generator regulates the frequency of the pressure impulses.

8. Apparatus as claimed in claim 6 wherein said nozzle is mounted for adjustment in at least one direction axially or radially within said mantle.

9. In a double twist twisting apparatus having a hollow twist spindle for at least one thread delivery bobbin and also having a balloon limiting mantle with an inner thread contacting surface encircling the twist spindle to limit the outward balloon path of thread which is drawn from the bobbin, passed through the hollow spindle and then directed outwardly into a rotating balloon pattern, the improved means for applying a liquid as a thread wetting agent onto said thread contacting surface which comprises:

dosing means to direct said liquid under repeated pressure impulses onto said thread contacting surfaces;

liquid feed control means including an impulse generator operatively connected with said dosing means to regulate said pressure impulses; and a pressure chamber for said liquid located on an outer circumferential portion of said mantle, said chamber being in liquid connection by means of porous openings through the mantle to its inner thread contacting surface and said chamber being fed in liquid connection with said dosing means.

10. Apparatus as claimed in claim 9 wherein said impulse generator regulates the frequency of the pressure impulses.

11. Apparatus as claimed in claim 10 wherein the porous openings from said pressure chamber to the inner thread contacting surface of said mantle are provided by felt inserts or similar wick means acting as a carrier for said liquid.

12. Apparatus as claimed in claim 11 wherein said pressure chamber is substantially filled with said felt or similar wick means.

13. Apparatus as claimed in claim 10 including one impulse generator operatively connected from a central location to a plurality of said dosing means, each dosing means directing said liquid through said pressure chamber onto the inner thread contacting surface of the mantle associated with each of a plurality of hollow twist spindles.

14. Apparatus as claimed in claim 13 including a central supply means to feed the liquid to each of said dosing means.

15. Apparatus as claimed in claim 10 including automatic switch-off means to disconnect said dosing means in response to a thread monitor actuated by breakage of the thread.

16. Apparatus as claimed in claim 10 including a winding spool to draw off and collect the twisted thread from said twist spindle and automatic switch-off means to disconnect said dosing means in response to a sensing element actuated by the winding diameter of the thread on said winding spool.

17. In a double twist twisting apparatus having a hollow twist spindle for at least one thread delivery bobbin and also having a thread contacting surface arranged in the path of thread being drawn from the bobbin, passed through the hollow spindle and then directed outwardly into a rotating balloon pattern, the improved means for applying a liquid as a thread wetting agent onto said thread contacting surface which comprises:

dosing means to direct said liquid under repeated pressure impulses onto said thread contacting surface;

a feed pump to supply said liquid to said dosing means under a constant pressure;

liquid feed control means including a valve member in said dosing means for producing pressure fluctuations and an impulse generator operatively connected to said valve member for repeated movement between a closed valve position and an open valve position transmitting said constant pressure to the liquid being directed onto said thread contacting surface, thereby regulating said repeated pressure impulses.

18. Apparatus as claimed in claim 17 wherein a plurality of said dosing means, each having a valve member and being associated with the thread contacting surface of an individual twist spindle, are connected in parallel with a single feed pump and a single impulse generator.

19. Apparatus as claimed in claim 17 wherein said thread contacting surface is formed by the inner circumferential surface of a balloon limiting mantle encircling the twist spindle, said mantle having a pressure chamber for said liquid located on an outer circumferential portion thereof, said chamber being in liquid connection by means of porous openings through the mantle to its inner thread contacting surface and said chamber being fed in liquid connection with said dosing means.

20. Apparatus as claimed in claim 19 wherein the porous openings from said pressure chamber to the inner thread contacting surface of said mantle are provided by felt inserts or similar wick means acting as a carrier for said liquid.

21. Apparatus as claimed in claim 19 wherein said pressure chamber is substantially filled with said felt or similar wick means.

22. In a double twist twisting apparatus having a hollow twist spindle for at least one thread delivery bobbin and also having a thread contacting surface arranged in the path of thread being drawn from the bobbin, passed through the hollow spindle and then directed outwardly into a rotating balloon pattern, the improvement for applying a liquid as a thread wetting agent onto said thread contacting surface which comprises:

dosing means to direct said liquid under repeated pressure impulses onto said thread contacting surface, said dosing means including a plurality of variable pressure pumps, each feeding said liquid to the thread contacting surface of an individual twist spindle and being connected in parallel with a common liquid supply means; and a single impulse generator operatively connected with said variable pressure pumps to impart said repeated pressure impulses to the liquid passing through each pump.

23. In a double twist twisting apparatus having a hollow twist spindle for at least one thread delivery bobbin and also having a thread contacting surface arranged in the path of thread being drawn from the bobbin, passed through the hollow spindle and then directed outwardly into a rotating balloon pattern, the improvement for applying a liquid as a thread wetting agent onto said thread contacting surface which comprises:

dosing means comprising a variable pressure piston pump to direct said liquid under repeated pressure impulses onto said thread contacting surface; and liquid feed control means including an impulse generator operatively connected with said dosing means to regulate said pressure impulses.

24. Apparatus as claimed in claim 23 wherein said piston pump includes a piston which is reciprocally movable axially of a cylinder bore between an inlet and outlet in the bore for pumping liquid therethrough, a stop means limiting the axial movement of the piston in the bore, a spring to resiliently move the piston in one direction up to said stop means, a magnetically operated push rod to move the piston in the other direction against the spring, and a check valve in the outlet of said bore to permit the outflow of liquid under pressure impulses developed by the reciprocal axial movement of the piston.

25. Apparatus as claimed in claim 24 wherein the inlet of said bore is located just before the dead center of the reciprocal piston movement in said bore.

26. Apparatus as claimed in claim 23 wherein said thread contacting surface is formed by the inner circumferential surface of a balloon limiting mantle encircling the twist spindle, said mantle having a pressure chamber for said liquid located on an outer circumferential portion thereof, said chamber being in liquid connection by means of porous openings through the mantle to its inner thread contacting surface and said chamber being fed in liquid connection with said dosing means.

27. In a double twist twisting apparatus having a hollow twist spindle for at least one thread delivery bobbin and also having a thread contacting surface arranged in the path of thread being drawn from the bobbin, passed through the hollow spindle and then directed outwardly into a rotating balloon pattern, the improvement for applying a liquid as a thread wetting agent onto said thread contacting surface which comprises:

dosing means comprising a diaphram pump to direct said liquid under repeated pressure impulses onto said thread contacting surface; and liquid feed control means including an impulse generator operatively connected with said dosing means to regulate said pressure impulses.

28. Apparatus as claimed in claim 27 wherein said impulse generator is connected to said diaphragm pump to regulate the frequency of the pressure impulses.

29. Apparatus as claimed in claim 27 wherein said thread contacting surface is formed by the inner circumferential surface of a balloon limiting mantle encircling the twist spindle, said mantle having a pressure chamber for said liquid located on an outer circumferential portion thereof, said chamber being in liquid connection by means of porous openings through the mantle to its thread contacting surface and said chamber being fed in liquid connection with said dosing means.

* * * * *